US006550571B1

(12) United States Patent
Kimura et al.

(10) Patent No.: US 6,550,571 B1
(45) Date of Patent: Apr. 22, 2003

(54) NOISE REDUCTION STRUCTURE FOR CAB OF WORKING VEHICLE

(75) Inventors: Keiji Kimura, Yokohama (JP); Kuniaki Nakada, Yokohama (JP)

(73) Assignee: Komatsu, Ltd., Tokyo (JP)

( * ) Notice: Subject to any disclaimer, the term of this patent is extended or adjusted under 35 U.S.C. 154(b) by 0 days.

(21) Appl. No.: 09/592,412

(22) Filed: Jun. 13, 2000

(30) Foreign Application Priority Data

Jun. 17, 1999 (JP) ..... 11-170887

(51) Int. Cl.[7] ..... G10K 11/04

(52) U.S. Cl. ..... 181/200; 181/202; 181/204; 181/207; 181/208

(58) Field of Search ..... 181/200, 202, 181/204, 207, 208, 286, 290

(56) References Cited

U.S. PATENT DOCUMENTS

| | | | | | |
|---|---|---|---|---|---|
| 3,732,746 | A | * | 5/1973 | Fitzpatrick | 74/473.29 |
| 3,918,541 | A | | 11/1975 | Krieger | 180/89 R |
| 3,954,150 | A | * | 5/1976 | Cole et al. | 180/89.12 |
| 4,099,590 | A | | 7/1978 | Martin, Sr. | 180/69 C |
| 4,191,273 | A | | 3/1980 | Williams | 180/89.13 |
| 4,247,586 | A | * | 1/1981 | Rochlin | 428/138 |
| 4,378,856 | A | * | 4/1983 | Miller | 180/89.14 |
| 4,574,915 | A | * | 3/1986 | Gahlaii et al. | 181/290 |
| 4,669,241 | A | * | 6/1987 | Kelly | 52/204.597 |
| 4,854,278 | A | | 8/1989 | Honecker | 123/198 |

FOREIGN PATENT DOCUMENTS

| | | | |
|---|---|---|---|
| DE | 2622473 | * | 12/1977 |
| DE | 297 17 226 U1 | | 12/1997 |
| EP | 0 499 640 A1 | | 8/1992 |
| JP | 60-65838 | | 4/1985 |
| JP | 5-126003 | | 5/1993 |
| JP | 8-81976 | | 3/1996 |
| JP | 11-324014 | | 11/1999 |
| JP | 2000-8419 | | 1/2000 |

OTHER PUBLICATIONS

Patent Abstracts of Japan vol. 1996, No. 07, Jul. 31, 1996 & JP 08/081976 A (Shin Caterpillar Mitsubishi Ltd), Mar. 26, 1996 *abstract*.

* cited by examiner

*Primary Examiner*—Shih-Yung Hsieh
(74) *Attorney, Agent, or Firm*—Armstrong, Westerman & Hattori, LLP.

(57) ABSTRACT

A noise reduction structure for a cab of a working vehicle, by which a high degree of noise reduction effectiveness can be surely obtained, is provided. For this purpose, the noise reduction structure has a configuration in which a sound-insulating chamber (A; B; C) adjacent to a cab (10*a*) is provided at a position of at least one of the following: under a floor (11*a*) of the cab (10*a*), behind a rear wall of the cab (10*a*), and at a side of a side wall of the cab (10*a*).

2 Claims, 7 Drawing Sheets

ENLARGED SECTIONAL VIEW

ENLARGED SECTIONAL VIEW

NOISE REDUCTION STRUCTURE FOR CAB OF WORKING VEHICLE

TECHNICAL FIELD

The present invention relates to a noise reduction structure for a cab of a working vehicle such as a hydraulic shovel.

BACKGROUND ART

A hydraulic shovel 1 being a working vehicle shown in FIG. 9 has a base carrier 2 and a revolving superstructure 4 rotatably mounted on the base carrier 2 (for example, Japanese Patent Laid-open No. 8-81976). The revolving superstructure 4 has a frame 12 at the lower part thereof. A working machine 6 is provided in the almost center of the front portion of the frame 12, a cab 10 is provided on either left or right side of the front portion thereof, and an engine room 8, which is covered with a cover and houses power plants such as an engine and a hydraulic pump not illustrated therein, is provided at the rear portion thereof.

In FIG. 10, a cab 10*c* is mounted on a top face of a frame 12*c* via vibration isolating members (not illustrated), with predetermined distance being spaced from the top face of the frame 12*c* and the front face of the engine room 8. The frame 12*c* is formed to be a frame shape so as to cover the entire perimeter of the side face of the lower part of the cab 10*c*. A cover 14 for protecting the bottom face of the cab 10*c* from earth and stones, and muddy water is mounted on the bottom face of the frame 12*c*. Further, a lever stand 26 mounted with a working machine lever 30 for operating the working machine 6, a console 28 mounted with a control unit 50, and a traveling lever 40 for performing a traveling operation, are mounted on the floor 11*c* of the cab 10*c*.

Pilot valves 31 and 41 for converting pilot oil pressure from a pilot pump (not illustrated) into command pilot oil pressure corresponding to a lever manipulated variable are respectively provided at the lower portion of the working machine lever 30 and the traveling lever 40. A plurality of hydraulic hoses 32 and 42, which are connected to hydraulic devices such as a pilot pump, an operating valve and a tank not illustrated, are connected to the pilot valves 31 and 41. It should be noted that control cables 32 and 42 are used instead of the hydraulic hoses 32 and 42 in some examples. A wiring harness 52 for exchanging signals with control devices, detectors and the like not illustrated is connected to the control unit 50.

The traveling lever 40 is mounted on the top face of the floor 11*c*, and thus the pilot valve 41 of the traveling lever 40 is mounted so as to be protruded below the floor 11*c* from a through-hole 45 of the floor 11*c*. The hydraulic hose 42 connected to the pilot valve 41 at a portion below the floor 11*c* extends under the floor 11*c* to be connected to the hydraulic devices behind the cab 10*c*.

The working machine lever 30 is mounted on the lever stand 26. Since the pilot valve 31 of the working machine lever 30 is located above the floor 11*c*, the hydraulic hose 32 connected thereto extneds under the floor 11*c* via a gromet 37 attached to a through-hole 35 of the floor 11*c* from above the floor 11*c* to be connected to the hydraulic devices behind the cab 10*c*. As shown in FIG. 11A and FIG. 11B, the gromet 37 is in an almost oval shape having a thin center portion 37*a* in the center portion and a thick perimeter portion 37*b* in the perimeter portion, and is made by rubber molding. A plurality of holes 37*c* having almost the same diameter as an outer diameter of the hydraulic hose 32 are provide at predetermined intervals in the center portion 37*c*, and slits 37*d* connecting the adjacent two holes 37*c* and 37*c* with each other arc provided for the purpose of passing a mouth piece of the hydraulic hose 32 through. A groove 37*e* with a predetermined depth with almost the same width as the thickness of the floor 11*c* is provided on an outer perimeter surface of the perimeter portion 37*b*.

Further, the working machine lever 30 has a structure which is capable of sliding in a longitudinal direction of the vehicle in accordance with a physique and preference of an operator, and in accordance with an operational situation such as an operation of digging a deep hole in which a forward tilting posture is required. The wiring harness 52 from the control unit 50 extends under the floor 11*c* via the through-hole not illustrated of the floor 11*c* from above the floor 11*c* to be connected to the control devices and detectors outside the cab 10*c*.

When an operator starts the engine and manipulates the working machine lever 30 or the traveling lever 40 to operate the hydraulic shovel 1 for operation, noises are generated from the power plants such as the engine, the hydraulic pump, and the like. The noises generated propagate into the cab 10*c*, and they propagate in such a manner as to especially concentrate on a rear face of the cab 10*c*, which is near the noise sources. Conventionally, in order to reduce noise, a structure which increases sound-insulating effectiveness, for example, by reducing a gap by means of a gromet, or providing sound-insulating members and the like is adopted in the cab 10*c*. However, recently, a demand for increased riding comfort and sound-insulating effectiveness in the cab 10*c* grows. Accordingly, further noise reduction inside the cab 10*c* is required.

Further, by sliding movement of the working machine lever 30, the hydraulic hose 32 moves together with the pilot valve 31. In this situation, due to the sliding amount, the rigidity and the thickness of the hydraulic hose 32, as shown in FIG. 11C, the hose 32 is on the skew at the gromet 37 section, which together with the existence of the slit 37*d*, causes a gap due to twisting. Further, since the hydraulic hose 32 is not fixed in the vicinity of the gromet 37 in order to absorb play caused by the sliding movement, a gap caused by the twist sometimes remains even if the sliding movement is stopped to return to the original position. For this reason, in the through-hole 35, a degree of sound-insulating effectiveness of the gromet 37 is extremely reduced. In addition, in the through-hole 45 section to which the traveling lever 40 is mounted, a secure sound-insulating structure sometimes cannot be achieved for the reason of design.

Since the cab 10*c* is mounted to be spaced from the frame 12*c*, due to the noise entering from a gap between the cab 10*c* and the frame 12*c*, a level of noise below the floor 11*c* is higher. Consequently, the noise below the floor 11*c* enters the inside of the cab 10*c* through the through-holes 35 and 45 where sound insulation is incomplete, which poses the big barrier to the noise reduction inside the cab 10*c*.

SUMMARY OF THE INVENTION

The present invention is made in view of the above disadvantages, and its object is to provide a noise reduction structure for a cab of a working vehicle, by which a higher level of noise reduction effectiveness can be surely obtained, in a working vehicle such as a hydraulic shovel. Another object is to provide the noise reduction structure for the cab which prevents noise from entering from through-holes provided in a floor and a wall surface of the cab for providing hydraulic hoses and a wiring harness, and has a higher level of noise reduction effectiveness, in the working vehicle such as a hydraulic shovel.

In order to attain the above object, a first aspect of a noise reduction structure for a cab of a working vehicle according to the present invention is in a noise reduction structure for a cab of a working vehicle, characterized in that a sound-insulating chamber adjacent to a cab is provided at a position of at least one of the following: under a floor of the cab, behind a rear wall of the cab, and at a side of a side wall of the cab.

According to the above configuration, out of the paths through which noises propagate into the cab of the working vehicle such as a hydraulic shovel, the noises propagating into the cab from the rear wall of the cab, the floor of the cab, and the side wall of the cab, which are near the noise sources and the main causes of noise, can be reduced by being passed through the sound-insulating chambers. Hence, working environment for an operator can be improved, and working efficiency can be improved. In addition, the sound-insulating chambers can be respectively realized with a simple structure utilizing the existing members such as the floor and the frame; the rear wall of the cab and the engine room; and the side wall of the cab and the boom supporting member.

A second aspect of a noise reduction structure for a cab of a working vehicle according to the present invention is in a noise reduction structure for a cab of a working vehicle in which at least one of hydraulic hoses, wiring harness and control cables is provided to extend from an inside of the cab to an outside thereof via through-holes provided in the cab, and noise entering via the through-holes is reduced, characterized by including:

a sound-insulating chamber which is provided adjacent to the cab, communicated with the cab via the through-holes, and sound-insulated from the outside, and characterized in that at least one of the hydraulic hoses; the wiring harness; and the control cables is provided to extend from the inside of the cab to the outside thereof via the through-holes and the sound-insulating chamber.

According to the above configuration, in the working vehicle such as a hydraulic shovel, the hydraulic hoses, the wire harness and the like are provided to extend from the inside of the cab to the outside thereof via the through-holes and the sound-insulating chambers. In this situation, even when sound insulation is difficult at the through-hole section, and even when sound insulation is difficult at the through-hole section at which the manipulating member is directly mounted on the floor, sound insulation is achieved at the exit portion to the outside from the sound-insulating chamber. As a result, noise from the outside is reduced in the sound-insulating chambers, and thereby the noise entering the inside of the cab from the sound-insulating chambers through the through-holes is reduced. Thus, the noise reduction inside the cab is made possible, the working environment for an operator can be improved, and working efficiency can be improved.

Further, with the through-hole being provided in the floor of the cab, the sound-insulating chamber may be configured to have the floor of the cab, the frame on which surface the cab is mounted, and the sound-insulating member for padding a gap between the cab and the frame. The sound-insulating chamber has a simple configuration in which the members such as the floor and the frame conventionally used are partially modified as necessary and the sound-insulating member is added. As a result, the noise reduction inside the cab is made possible with a simple structure, and the working environment for an operator is improved, thus making it possible to improve working efficiency.

BRIEF DESCRIPTION OF THE DRAWINGS

FIG. 8A is an explanatory view in the case in which a circular rubber tube having a plan portion is used, and FIG. 8B is an explanatory view in the case in which a circular rubber tube having a slit is used;

FIG. 11A is a plan view of the gromet, FIG. 11B is a sectional side view of the gromet with hydraulic hoses being attached therein, and FIG. 11C is a sectional side view of the gromet with the hydraulic hoses being on the skew.

BEST MODE FOR CARRYING OUT THE INVENTION

Figure 9:
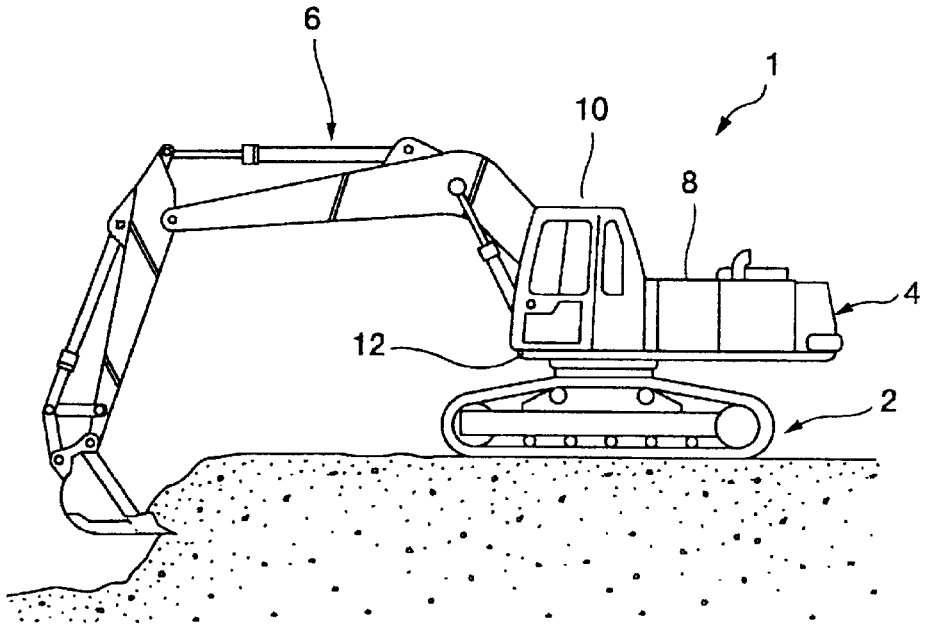
FIG. 9 PRIOR ART
FIG. 9 is a side view of a hydraulic shovel being an ordinary working vehicle.
Figure 10:
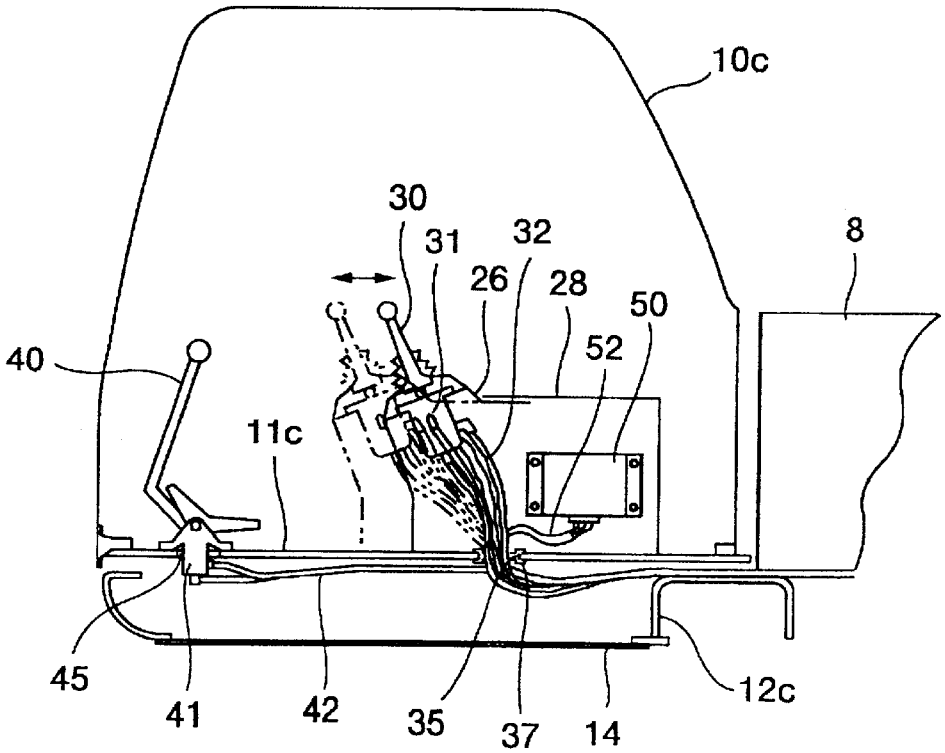
FIG. 10 PRIOR ART
FIG. 10 is a sectional side view showing a conventional cab and frame.

A preferred embodiment of the present invention will be explained below with reference to the drawings. Here, as a working vehicle to which a noise reduction structure for a cab of a working vehicle according to the present invention, an example of a hydraulic shovel 1 shown in FIG. 9 is cited for explanation, but the present invention is not limited to the above.

A first embodiment of the present invention will be explained in detail with reference to FIG. 1, FIG. 2 and FIG. 3.

Figure 1:
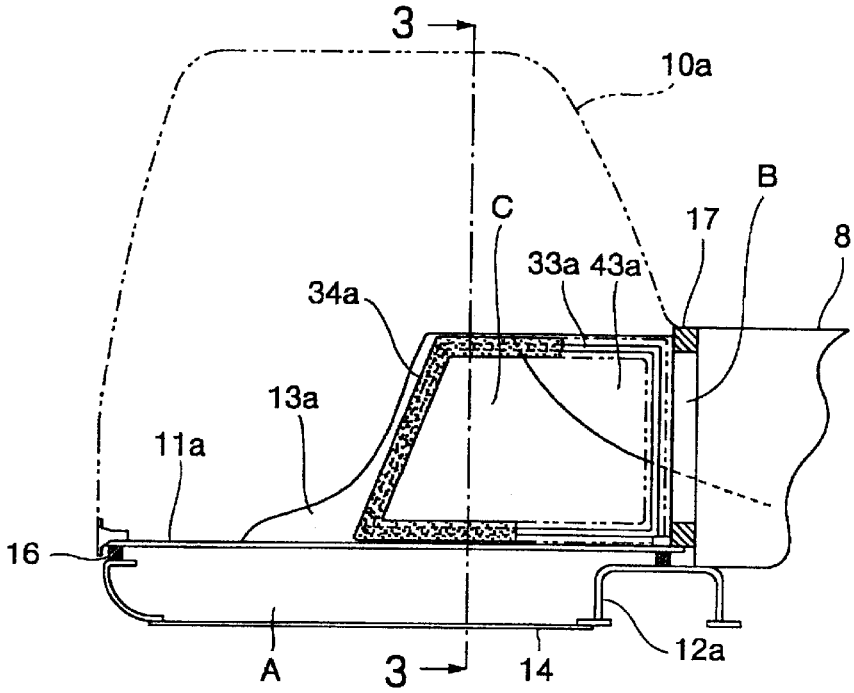
FIG. 1 is a sectional side view showing a cab, a frame, and an engine room of a first embodiment of the present invention.

In FIG. 1, a cab 10*a* is mounted on a top face of a frame 12*a* via vibration isolating members 18 (See FIG. 2) in each of four corners of a floor 11*a* of the cab 10*a,* with predetermined distances being spaced respectively from the top face of the frame 12*a* and the front face of an engine room 8. The frame 12*a* is formed to be a frame shape so as to cover the entire perimeter of the side surface of the lower part of the cab 10*a*. A cover 14 for protecting the bottom face of the cab 10*a* from earth and stones, and muddy water is mounted on the bottom face of the frame 12*a*.

Figure 2:
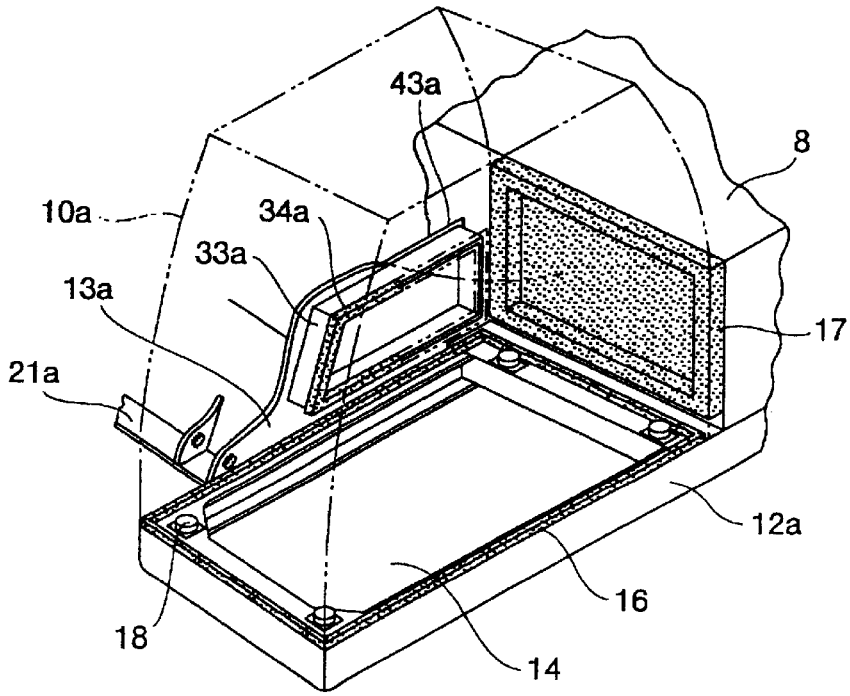
FIG. 2 is a perspective view of portions of the frame and engine room, to which the cab is mounted, according to the first embodiment of the present invention.

As shown in FIG. 2, a sound-insulating member 16 consisting of, for example, urethane foam having a predetermined width with a thickness a little larger than a space between the floor 11*a* and the frame 12*a* is attached on the top face of the frame 12*a* along the entire perimeter of the bottom face of the floor 11*a*.

As shown in FIG. 2, a sound-insulating member 17 consisting of, for example, urethane foam having a predetermined width with a thickness a little larger than a space between a rear wall of the cab 10*a* and the engine room 8 is attached on the front face of the engine room 8 along the entire perimeter of the rear wall of the cab 10*a*.

Figure 3:
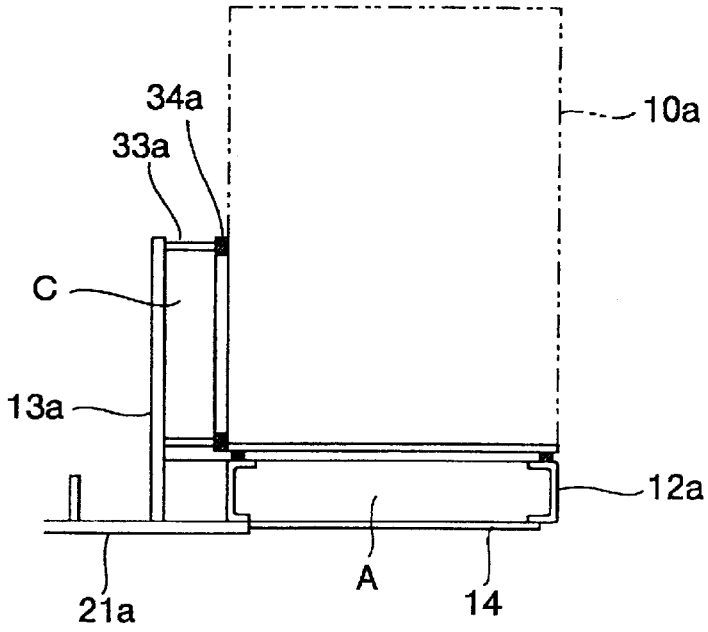
FIG. 3 is a sectional view taken along the line 3—3 in FLG. 1.

As shown in FIG. 3, a boom supporting member 13*a* is vertically provided on a top surface of a frame 21*a* integrally constructed with the frame 12*a,* at the side of the side wall of the cab 10*a,* which is near the center of the vehicle body. A plate 43*a,* which covers the side wall of the cab 10*a* integrally with the boom supporting member 13*a* up to a position at which it meets the rear end surface of the cab 10*a,* is attached to the boom supporting member 13*a* by welding or the like on the side toward the rear of the vehicle. The plate 43*a* has almost the same height as the uppermost end portion of the boom supporting member 13*a,* and its side surface toward the cab 10*a* forms the same surface as the side surface of the boom supporting member 13*a,* which is toward the cab 10*a*.

On the surfaces of the boom supporting member 13*a* and the plate 43*a* toward the cab 10*a* side, a plate 33*a* having a little shorter length than a space between the side wall of the cab 10*a* and the boom supporting member 13*a* is vertically provided along an entire perimeter a little inward from the outer perimeter of a portion facing the side wall of the cab 10*a*. Further, a sound-insulating member 34*a* formed of, for example, urethane foam, which has a predetermined width and a little larger thickness than a space between the side wall of the cab 10*a* and the plate 33*a* is attached along the entire perimeter of an end portion of the plate 33*a* toward the cab 10*a* side.

According to the above configuration, a sound-insulating chamber A, which is surrounded by the floor 11*a,* the sound-insulating member 16, the frame 12*a,* and the cover 14, is formed under the cab 10*a*. Noise entering the sound-insulating chamber A is reduced by the insulating action of the members forming the sound-insulating chamber A.

Further, a sound-insulating chamber B, which is surrounded by the rear wall of the cab 10*a,* the sound-insulating member 17, and the engine room 8, is formed behind the rear wall of the cab 10*a*. Noise entering the sound-insulating chamber B is reduced by the insulating action of the members forming the sound-insulating chamber B.

Furthermore, a sound-insulating chamber C, which is surrounded by the side wall of the cab 10*a,* the boom supporting member 13*a,* the plate 43*a,* the sound-insulating member 34*a,* and the plate 33*a,* is formed at the side of the side wall of the cab 10*a*. Noise entering the sound-insulating chamber C is reduced by the insulating action of the members forming the sound-insulating chamber C.

According to the above configuration, noises propagating into the cab 10*a* from the rear wall of the cab 10*a,* the floor 11*a* of the cab 10*a* and the side wall of the cab 10*a,* which are the paths located near the noise source and mainly causing noises, out of the paths of noises propagating into the cab 10*a,* can be reduced by being respectively passed through the sound-insulating chambers A, B and C. Thus, working environment for an operator is improved, thereby making it possible to improve working efficiency. Further, the sound-insulating chambers A, B and C can be achieved with a simple structure utilizing the already-existing members such as the floor 11*a* and the frame 12*a,* the rear wall of the cab 10*a* and the engine room 8, and the side wall of the cab 10*a* and the boom supporting member 13*a,* respectively.

Figure 4:
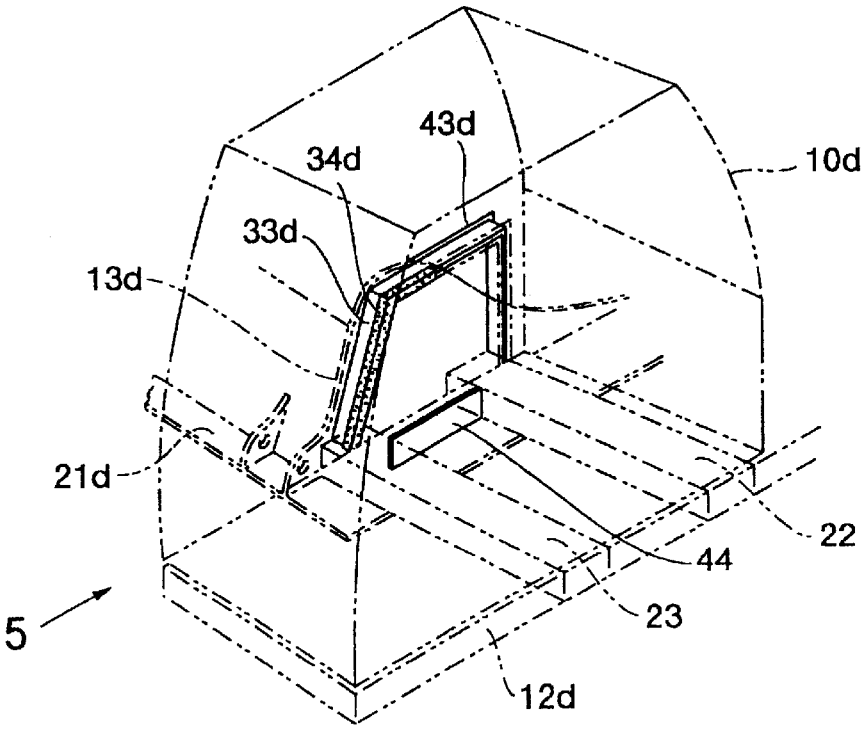
FIG. 4 is a perspective view showing another embodiment regarding a sound-insulating chamber of the first embodiment of the present invention.
Figure 5:
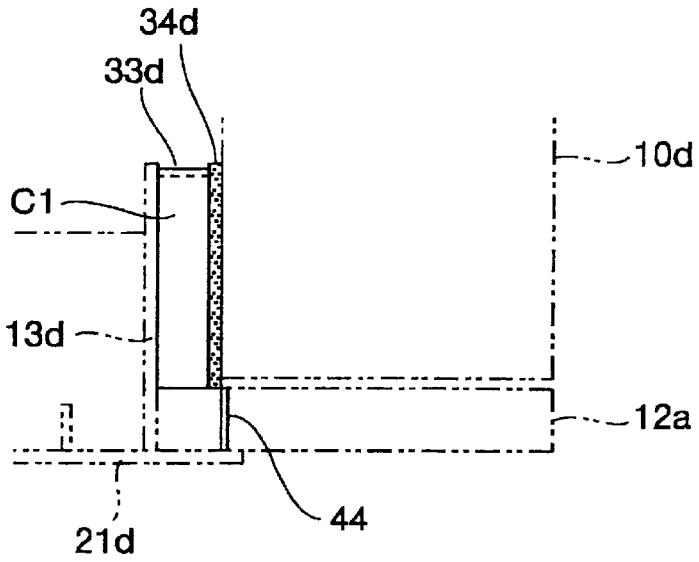
FIG. 5 is a view seen in the direction of the arrow 5 in FIG. 4.

Next, another example of the first embodiment regarding the sound-insulating chamber C will be explained with reference to FIG. 4 and FIG. 5.

A boom supporting member 13d is vertically provided on a top face of a frame 21d integrally constructed with the frame 12*d,* at the side of the side wall of the cab 10*d* near the center of the vehicle body. A plate 43*d,* which covers the side wall of the cab 10*d* integrally with the boom supporting member 13*d* up to a position at which it meets the rear end surface of the cab 10*d,* is attached to the boom supporting member 13*d* by welding or the like on the side toward the rear of the vehicle. The plate 43*d* has almost the same height as the uppermost end portion of the boom supporting member 13*d,* and its side surface toward the cab 10*d* forms the same surface as the side surface of the boom supporting member 13*d* at the cab 10*d* side.

The frame 12*d* has beams 22 and 23 which is on the top surface of the frame 21*d* and extends in a direction of the cab 10*d* from the side surface of the boom supporting member 13*d*. Sections of the beams 22 and 23, which face to longitudinal directions of the beams 22 and 23, are in a U-shaped form with the opening thereof facing downward. The beam 22 is located at a rear portion of the cab 10*d,* and the beam 23 is located almost in the center of the cab 10*d*.

On the surfaces of the boom supporting member 13*d* and the plate 43*d* toward the cab 10*d* side, a plate 33*d* having a little shorter length than a space between the side wall of the cab 10*d* and the boom supporting member 13*d* is vertically provided along a side a little inward from the upper end and the left and right end of the perimeter of a portion facing to the side wall of the cab 10*d*. One of the longitudinal ends of the plate 33*d* is in contact with the beam 22 and the other end is in contact with the beam 23.

Further, a sound-insulating member 34*d* formed of, for example, urethane foam, which has a predetermined width and a little larger thickness than a space between the side wall of the cab 10*d* and the plate 33*d* is attached to an end portion of the plate 33*d* toward the cab 10*b* side along the entire surface of the end portion.

On the top face of the plate 21*d,* a plate 44, which has almost the same height as a space between the plate 21*d* and the cab 10*d,* and which has a width almost equal to a space between the beams 22 and 23, is attached at a lower position of the side wall of the cab 10*d* near the center of the vehicle.

According to the above configuration, a sound-insulating chamber C1, which is surrounded by the side wall of the cab 10*d,* the boom supporting member 13*d,* the plate 43*d,* the sound-insulating member 34*d,* the plate 33*d,* the plate 21*d,* the beams 22 and 23, and the plate 44, is formed at the side of the side wall of the cab 10*d*. A noise entering the sound-insulating chamber C1 is reduced by the insulating action of the members forming the sound-insulating chamber C1.

Even if a sound-insulating member of urethane foam or the like is used instead of the plate 44, the same operational effects can be obtained. Further, even if the plate 44 is eliminated, and a configuration in which the sound-insulating chamber C1 is communicated with the sound-insulating chamber A under the cab 10*d,* the same operational effects can be obtained.

Next, a second embodiment according to the present invention will be explained in detail with reference to FIG. 6 and FIG. 7.

Figure 6:
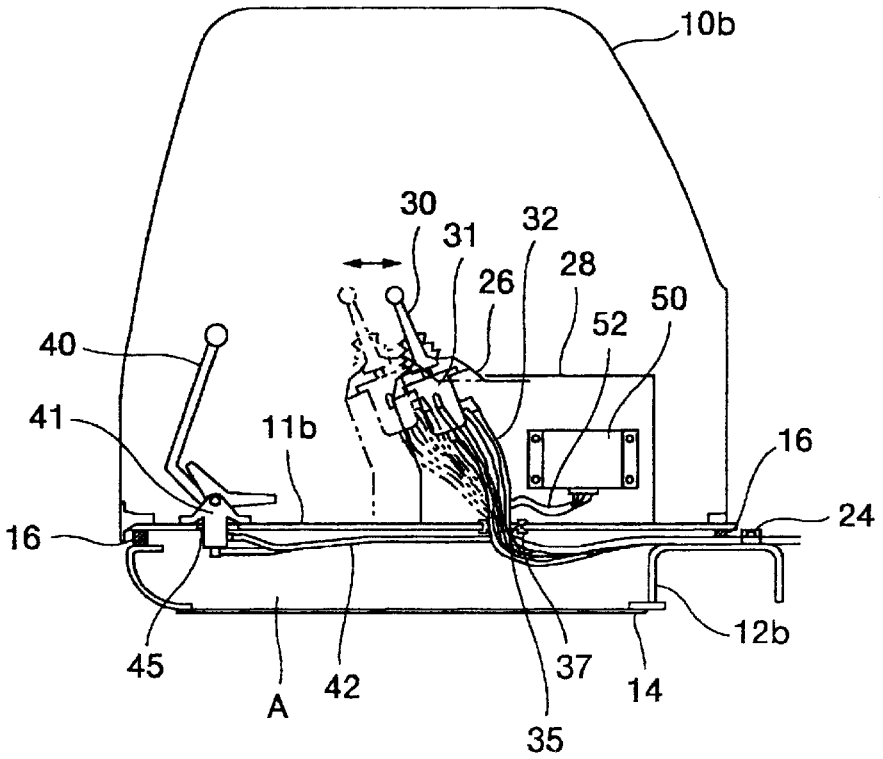
FIG. 6 is a sectional side view showing a cab and a frame of a second embodiment of the present invention.
Figure 7:
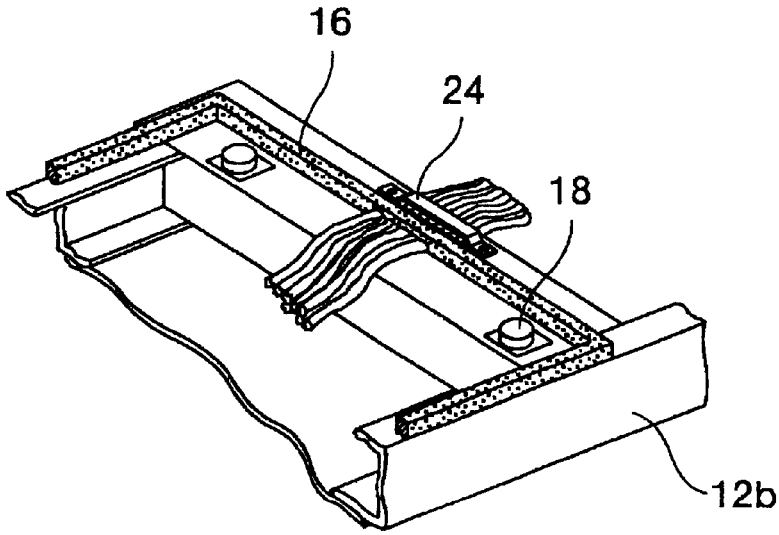
FIG. 7 is a fragmentary perspective view of a portion of the frame, to which the cab is mounted, according to the second embodiment of t resent invention.

In FIG. 6, a cab 10*b* is mounted on a top face of a frame 12*b* via vibration isolating members 18 shown in FIG. 7 in each of four corners of a floor 11*b,* with predetermined distance being spaced from the top face of the frame 12*b*. The frame 12*b* is formed to be a frame shape so as to cover the entire perimeter of the side face of the lower part of the cab 10*b*. A cover 14 for protecting the bottom surface of the cab 10*b* from earth and stones, and muddy water is mounted on the bottom surface of the frame 12*b*. Further, a lever stand 26 mounted with a working machine lever 30 for operating the working machine 6, a console 28 mounted with a control unit 50, and a traveling lever 40 for performing traveling operation, are mounted on the floor 11*b* of the cab 10*b*.

Pilot valves 32 and 41 for converting pilot oil pressure from a pilot pump (not illustrated) into command pilot oil pressure corresponding to a lever manipulated variable are respectively provided at the lower portion of the working machine lever 30 and the traveling lever 40. A plurality of hydraulic hoses 32 and 42, which are connected to hydraulic devices such as a pilot pump, an operating valve and a tank not illustrated, are connected to the pilot valves 31 and 41. Further, a wiring harness 52 for exchanging signals with control devices, detectors and the like not illustrated is connected to the control unit 50.

The traveling lever 40 is mounted on the top surface of the floor 11*b*. The pilot valve 41 of the traveling lever 40 is mounted so as to be protruded below the floor 11*b* from a through-hole 45 of the floor 11*b,* and the hydraulic hose 42 connected thereto extends under the floor 11*b* to be connected to the hydraulic devices behind the cab 10*b*. In the through-hole 45 section to which the traveling lever 40 is mounted, a proper sound insulating structure can not be sometimes achieved due to the design.

Figure 11A:
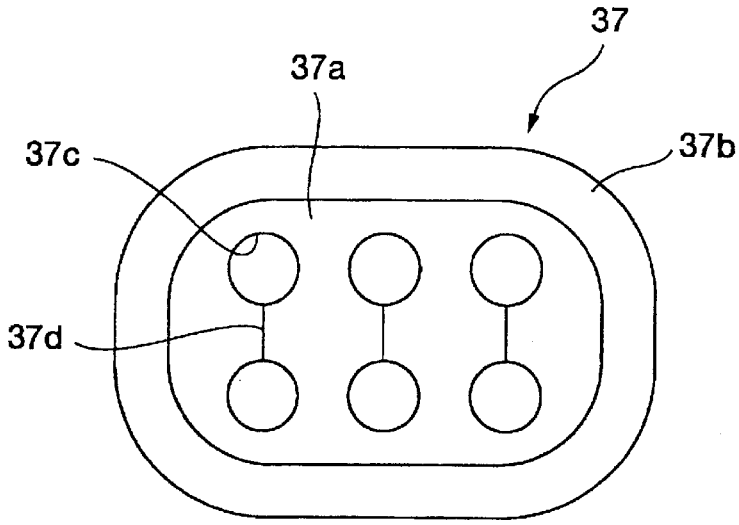
FIG. 11A PRIOR ART
FIG. 11A to FIG. 11C are views explaining a state of a gromet and a hoc according to a prior art.
Figure 11B:
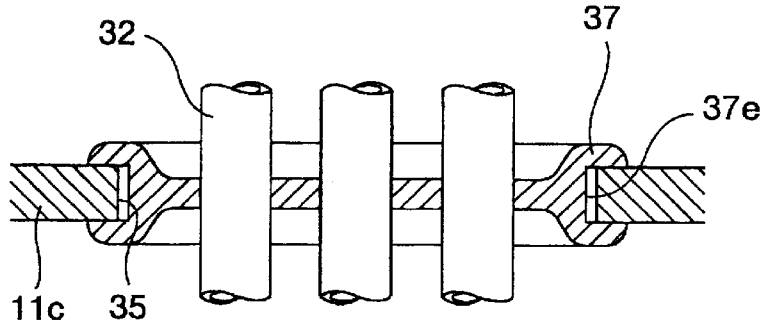
FIG. 11B PRIOR ART

The working machine lever 30 is mounted on the lever stand 26. Since the pilot valve 31 of the working machine lever 30 is located above the floor 11*b,* the hydraulic hose 32 connected thereto extends under the floor 11 via a gromet 37 attached at a through-hole 35 of the floor 11*b* from above the floor 11*b* to be connected to the hydraulic devices behind the cab 10*b*. As shown in FIG. 11A and FIG. 11B, the gromet 37 is in an almost oval shape having a thin center portion 37*a* in the center portion and a thick perimeter portion 37*b* in the perimeter portion, and is made by rubber molding. A plurality of holes 37*c* having almost the same diameter as an outer diameter of the hydraulic hose 32 are provide at predetermined intervals in the center portion 37*a,* and slits 37*d* connecting the adjacent two holes with each other are provided for the purpose of passing a mouth piece of the hydraulic hose 32 through. A groove 37*c* with a predetermined depth with almost the same width as the thickness of the floor 11*c* is provided on an outer perimeter surface of the perimeter portion 37*b*.

Figure 11C:
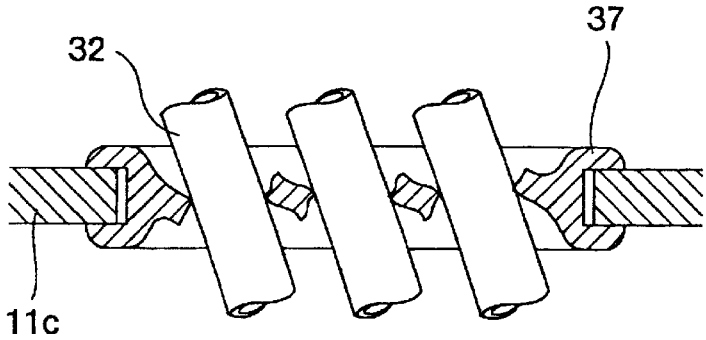
FIG. 11C PRIOR ART

Further, the working machine lever 30 has a structure which is capable of sliding in a longitudinal direction of the vehicle in accordance with a physique and preference of an operator, and in accordance with an operational situation such as an operation of digging a deep hole in which a forward tilting posture is required. By the sliding movement, the hydraulic hose 32 is also moved together with the pilot valve 31. As a result, in accordance with a sliding amount, and rigidity and thickness of the hydraulic hose 32, the hose 32 is on the skew at the gromet 37 section, thus causing a gap due to the twist as shown in FIG. 11C.

The wiring harness 52 from the control unit 50 extends under the floor 11*b* via the through-hole 35 from above the floor 11*b* to be connected to the control devices and detectors outside the cab 10*b*. In some cases, control cables 32 and 42 are used instead of the hydraulic hoses 32 and 42. In these cases, the traveling lever 40 or the working machine lever 30 is connected to the hydraulic devices behind the cab 10*b* by means of the control cables 32 or 42, and a gap is similarly produced at the grommet 37 section.

As FIG. 7 shows, on the top surface of the frame 12*b,* the sound-insulating member 16 made of urethane foam, which has a predetermined width and a little larger thickness than the space between the floor 11*b* and the frame 12*b,* is attached along the entire perimeter of the bottom surface of the floor 11*b*. The hydraulic hoses 32 and 42 (or the control cables 32 and 42), and the wiring harness 52 extending under the floor 11*b* toward the back of the cab 10*b* are fixed by means of a clamp 24 laterally placed in a line at a position in the vicinity of the rear end portion of the cab 10*b* on the upper surface of the frame 12*b* as shown in FIG. 7.

According to the above configuration, the sound-insulating chamber A surrounded by the floor 11*b,* the sound-insulating member 16, the frame 12*b* and the cover 14 is formed under the cab 10*b*. Noise entering the sound-insulating chamber A is reduced by the sound insulating action of the members forming the sound-insulating chamber A. As for the form of the hydraulic hoses 32 and 42 (or the control cables 32 and 42) and the wiring harness 52 at the sound-insulating member 16 section, they are laterally aligned in a line and fixed with the clamp 24, and are pressed down by the sound-insulating member 16. Thus, in the sound-insulating member 16 section, noise entering the sound-insulating chamber A from the outside is reduced. As a result, the sound-insulating chamber A becomes a space which less noise enters from the outside. Consequently, even when a sound insulation is difficult at the through-hole 35 section due to a gap caused by the twist occurring at the gromet 37 section, and even when sound insulation is difficult at the through-hole 45 section at which the traveling lever 40 is mounted, noise entering the inside of the cab 10*b* through the through-holes 35 and 45 is reduced to a lower level.

As a result, an insulation structure, which is difficult to be achieved at the through-holes 35 and 45 and the like, which are provided in the floor 11*b* and the wall surface of the cab 10*b* and used for providing the hydraulic hoses 32 and 42, and the wiring harness 52, can be realized with a simple structure in which the space surrounded by the floor 11*b* and the frame 12*b* is made to be the sound-insulating chamber A. Further, by providing the sound-insulating chamber A, noise in the cab 10*b* can be further reduced, and operation environment for an operator can be improved, thereby making it possible to improve working efficiency.

The embodiments according to the present invention are described in detail thus far, but the shapes of the frames 12*a* and 12*b* are not limited to a rectangular shape, and they may include, for example, a circular and an oval shape. Further, part of the frames 12*a* and 12*b,* the cover 14, and the sound-insulating members 16 and 17, which form the sound-insulating chamber may have an open portion such as a groove or an opening at a position with less noise from outside. As noise insulating members 16 and 17, urethane foam is cited as an example, but if it has the similar function, glass wool, felt and the like may be suitable.

Figure 8A:
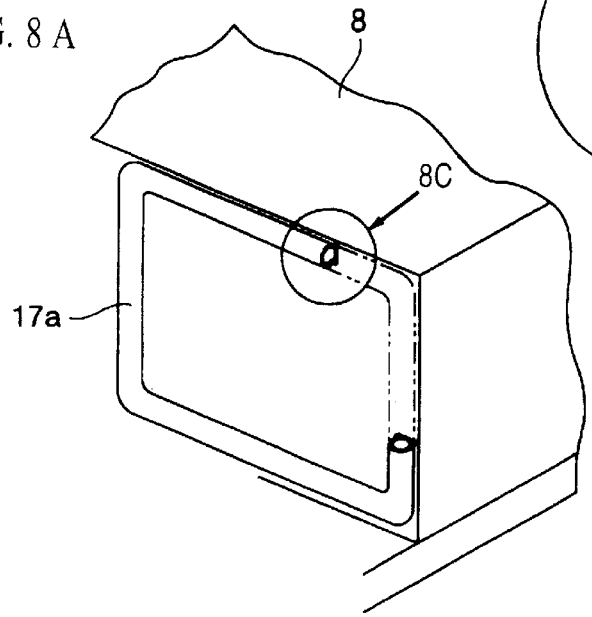
FIG. 8A and FIG. 8B show another embodiment regarding placement of a sound-insulating member of the present invention.
Figure 8C:
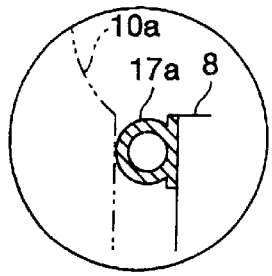
FIG. 8C is an enlarged sectional view of the circular rubber tube.
Figure 8B:
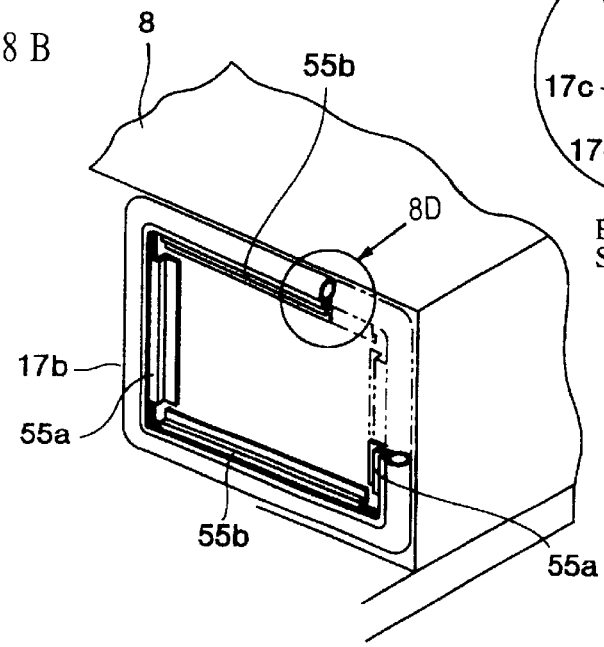
Figure 8D:
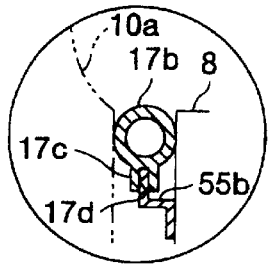
FIG. 8D is an enlarged sectional view of the circular rubber tube having a slit.

Further, as the sound-insulating members 16 and 17, a rubber tube having a little larger outer diameter than the space to be sound-insulated may be provided in a circular shape. For example, as shown in FIG. 8A, a circular-shaped rubber tube 17*a* having a plan portion as a sectional shape may be used. In this case, the plan portion of the rubber tube 17*a* may be placed on the wall surface of the engine room 8 by means of an adhesive. Further, as shown in FIG. 8B, a circular-shaped rubber tube 17*b,* which has a thick portion 17*c* formed at one longitudinal end and a slit 17*d* formed in a longitudinal direction of the thick portion 17*c,* may be used. In this case, supporting members 55*a* and 55*b,* of which end surfaces are located in almost the center of the gap between the rear wall of the cab 10*a* to be sound-insulated and the engine room 8, and which supports the rubber tube 17*b* from the inner perimeter side of the rubber tube 17*b* to be provided, are used. The supporting members 55*a* and 55*b* are provided on the wall surface of the engine room 8, and the end surfaces of the supporting members 55*a* and 55*b* are inserted into the slit 17*d* of the rubber tube 17*b.*

An example, in which the hydraulic hoses 32 and 42, the wiring harness 52 and the like are drawn out of the cab 10*b* via the sound-insulating chamber A at the frame 12*b* section under the cab 10*b,* is cited in the second embodiment. However, it goes without saying that the hydraulic hoses 32 and 42, the wiring harness 52 and the like may be drawn out of the cab 10*b* via the sound-insulating chamber B behind the cab 10*a* shown in the first embodiment. Further, in the above embodiment, the example with the hydraulic shovel 1 is explained, but the present invention is not limited to the hydraulic shovel 1, and it is applicable to various kinds of working vehicles.

What is claimed is:

1. A cab for a working vehicle for reducing noise in the cab, comprising:

a sound-insulating chamber, which is different and independent from a space having a source of noise, being located adjacent to said cab at a position of an existing member of said cab, which does not include a window of said cab, and which is located at at least one of the following locations:

under a floor of said cab, behind a rear wall of said cab, and at a side wall of said cab, wherein said sound-insulating chamber is formed by an existing member of said cab, a part located at a side of the space having said source of noise, and a sound-insulating material between the existing member of said cab and the part located at the side of said space having said source of noise.

2. The cab for the working vehicle according to claim 1, having at least one of hydraulic hoses, wiring harness and control cables extending from the inside of said cab to the outside of said cab, wherein said hydraulic hoses, wiring harness or control cables enter said sound-insulating chamber from said cab via through-holes in the existing member of the cab and exit said sound-insulating chamber via openings located in the parts of the sound-insulating chamber different from the existing member of the cab.

* * * * *